US008398212B2

(12) United States Patent
Okano et al.

(10) Patent No.: US 8,398,212 B2
(45) Date of Patent: Mar. 19, 2013

(54) INK JET HEAD AND METHOD OF MANUFACTURING THE SAME

(75) Inventors: Akihiko Okano, Kawasaki (JP); Masahiko Kubota, Tokyo (JP); Ryoji Kanri, Zushi (JP); Atsushi Hiramoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 469 days.

(21) Appl. No.: 12/635,948

(22) Filed: Dec. 11, 2009

(65) Prior Publication Data

US 2010/0149260 A1 Jun. 17, 2010

(30) Foreign Application Priority Data

Dec. 15, 2008 (JP) ..... 2008-318510

(51) Int. Cl.
*B41J 2/05* (2006.01)

(52) U.S. Cl. ..... 347/64

(58) Field of Classification Search ..... 347/64–65, 347/40–43, 47
See application file for complete search history.

(56) References Cited

U.S. PATENT DOCUMENTS

| | | | | |
|---|---|---|---|---|
| 6,143,190 | A | 11/2000 | Yagi | |
| 8,007,069 | B2 * | 8/2011 | Shimomura et al. | 347/20 |
| 2003/0016270 | A1 * | 1/2003 | Kubota et al. | 347/47 |
| 2005/0128248 | A1 * | 6/2005 | Wada et al. | 347/49 |
| 2008/0259120 | A1 * | 10/2008 | Misumi | 347/43 |

* cited by examiner

*Primary Examiner* — Lamson Nguyen
(74) *Attorney, Agent, or Firm* — Canon USA Inc IP Division

(57) ABSTRACT

An ink jet head includes a Si substrate with a surface having a {100} orientation; a passage holding ink on the Si substrate; an ink discharge port which is communicatively connected to the passage and through which ink is ejected; and a supply port which extends through the Si substrate, which is communicatively connected to the passage, and which supplies ink to the passage. The supply port has walls having two {111} planes facing each other.

5 Claims, 7 Drawing Sheets

INK JET HEAD AND METHOD OF MANUFACTURING THE SAME

BACKGROUND OF THE INVENTION

1. Field of the Invention

The present invention relates to an ink jet head and a method of manufacturing the ink jet head.

2. Description of the Related Art

In general, ink jet heads used for ink jet recording methods (liquid-ejecting recording methods) in which recording liquids are ejected to perform recording include ink passages, substrates including energy-generating elements for ejecting ink droplets placed in portions of the ink passages, and fine ink discharge ports (referred to as "orifices") for ejecting the ink droplets in the ink passages with the energy generated from the energy-generating elements.

U.S. Pat. No. 6,143,190 discloses a method of forming a supply port for supplying ink to energy-generating elements by anisotropic etching. In this method, when a {100} plane of a silicon wafer with a {100} orientation is etched, etching proceeds such that a {111} plane which is inclined at an angle of 54.7 degrees to an etching start surface and which is tapered in the thickness direction is obtained. Among crystal planes of silicon, the {111} plane is unlikely to be etched with a solution.

On the other hand, in the case of setting the area of a front surface aperture of a supply port to a predetermined value, the area of a back surface aperture of the supply port is greater than the area of the front surface aperture of the supply port. Since the back surface of a substrate is a junction with a member for supporting the substrate, the back surface of the substrate needs to have a portion with an area sufficient to form a good bond therebetween.

A supply port can be formed in a substrate with a {100} orientation by a dry etching process so as to have a wall perpendicular to the substrate. However, it is difficult to form the supply port in a {111} plane of the substrate because the {111} plane thereof is resistant to etching.

SUMMARY OF THE INVENTION

The present invention provides an ink jet head which can be securely bonded to a support substrate for supporting the ink jet head and which includes a supply port having walls highly resistant to liquids. Furthermore, the present invention provides a method of readily manufacturing such an ink jet head.

An ink jet head according to an embodiment of the present invention includes a Si substrate with a surface having a {100} orientation; a passage holding ink on the Si substrate; an ink discharge port which is communicatively connected to the passage and through which ink is ejected; and a supply port which extends through the Si substrate, which is communicatively connected to the passage, and which supplies ink to the passage. The supply port has walls having two {111} planes facing each other.

According to the present invention, the following head can be obtained: an ink jet head which includes an ink supply port having walls having {111} planes highly resistant to ink, which has high adhesion to a support substrate bonded to the ink jet head, and which has high reliability.

Further features of the present invention will become apparent from the following description of exemplary embodiments with reference to the attached drawings.

DESCRIPTION OF THE EMBODIMENTS

A method of manufacturing an ink jet head according to an embodiment of the present invention will now be described in detail with reference to the attached drawings. FIGS. 1A to 1G are schematic views illustrating steps of the method.

Step 1: Formation of Ink Passages and Ink Discharge Ports

Figure 1A:
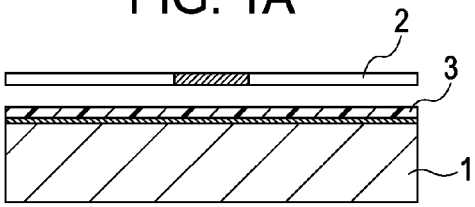
FIG. 1 is a schematic sectional view illustrating a method of manufacturing an ink jet head according to an embodiment of the present invention.

In this step, a photodegradable positive resist layer 3 is formed on a substrate 1 as shown in FIG. 1A.

The substrate 1 is made of Si and carries energy-generating elements (not shown) for ejecting ink. Examples of the energy-generating elements include, but are not limited to, electric heat-generating elements and piezoelectric elements. When the energy-generating elements are electric heat-generating elements, a protective layer (not shown) may be formed over the electric heat-generating elements for the purpose of reducing the impact caused by bubbling, the purpose of preventing damage caused by ink, and/or the like.

Examples of a photodegradable positive resist used to form the photodegradable positive resist layer 3 include, but are not limited to, common resists, such as poly(methyl isopropenyl ketone) (PMIPK) and poly(vinyl ketone), sensitive to light with a wavelength of about 290 nm and methacrylate unit-containing polymers, such as poly(methyl methacrylate) (PMMA), sensitive to light with a wavelength of about 250 nm.

Figure 1B:
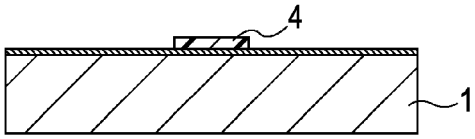

After the photodegradable positive resist layer 3 is formed, a predetermined region is removed from the photodegradable positive resist layer 3 by a photolithographic process including an exposure step and a development step, whereby ink passage patterns (structures) 4 is formed as shown in FIG. 1B.

The photodegradable positive resist layer 3 is irradiated with an ionizing radiation through a quartz mask 2 having the same pattern as each ink passage pattern 4. The ionizing radiation used has a wavelength which is close to about 250 or 290 nm and to which the photodegradable positive resist used herein is sensitive. This allows a region of the photodegradable positive resist layer 3 that is irradiated with the ionizing radiation to be degraded to selectively increase the solubility of this region in a developing liquid. Therefore, the structures 4, which are used to form ink passages 20, can be formed above the substrate 1 by developing the photodegradable positive resist layer 3 irradiated with the ionizing radiation.

The developing liquid is not particularly limited and may be a solvent that does not dissolve an unexposed region but dissolves an exposed region increased in solubility.

Figure 1C:
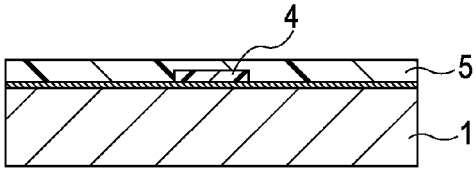

The structures 4 are coated with a negative resist layer 5 for forming the walls of the ink passages 20 as shown in FIG. 1C.

A negative resist used to form the negative resist layer 5 may be, but is not limited to, one based on a reaction such as cationic or radical polymerization. For example, a negative resist based on cationic polymerization is cured in such a manner that molecules of a cationically polymerizable monomer or polymer contained in this negative resist are polymerized or cross-linked by cations generated from a cationic photoinitiator contained in this negative resist. Examples of the cationic photoinitiator include aromatic iodonium salts and aromatic sulfonium salts and, in particular, include photoinitiators, SP-170™ and SP-150™, commercially available from Adeka Corporation.

Suitable examples of the cationically polymerizable monomer or polymer include, but are not limited to, those containing an epoxy group, a vinyl ether group, or an oxetane group.

The negative resist layer 5 is can be formed in such a manner that the negative resist is applied to the structure 4 by a spin coating process, a direct coating process, a laminate transfer process, or another process.

An ink-repellent layer (not shown) is formed on the negative resist layer 5 as required. The ink-repellent layer, as well as the negative resist, is preferably cross-linkable and sensitive to light. It is important that the ink-repellent layer is incompatible with the negative resist. The ink-repellent layer can be formed by a spin coating process, a direct coating process, a laminate transfer process, or another process.

Figure 1D:
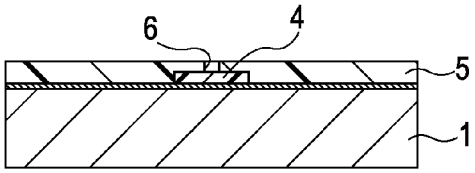

Ink discharge ports 6 is formed in predetermined portions of the negative resist layer 5 as shown in FIG. 1D.

In this operation, the negative resist layer 5 is cured in such a manner that a region other than portions for forming the ink discharge ports 6 is irradiated with light and the portions for forming the ink discharge ports 6 are shielded from light. The ink-repellent layer is cured together with the negative resist layer 5 and the resulting ink-repellent layer and negative resist layer 5 are developed, whereby the ink discharge ports 6 are formed. The following liquid is most suitable for the negative resist layer 5 and the ink-repellent layer: a developing liquid which is incapable of dissolving an exposed portion but is capable of completely dissolving off an unexposed portion and which does not dissolve the photodegradable positive resist (the structure 4), which is disposed under the negative resist layer 5. Examples of the developing liquid include methyl isobutyl ketone and a solvent mixture of methyl isobutyl ketone and xylene. The reason for why it is important that the photodegradable positive resist is not dissolved in this operation is as described below. In usual, a plurality of heads are provided on a single wafer and the wafer is cut into ink jet heads. Therefore, a photodegradable positive resist for forming ink passage patterns is preferably dissolved off subsequently to the cutting of the wafer for waste reduction.

The ink passages 20 and the ink discharge ports 6 may be formed after ink supply ports 8 below is formed. In this case, the formed ink supply ports 8 may be filled with resin or ink passages formed in different substrates may be attached to each other.

Step 2: Formation of Ink Supply Ports

A step of forming the ink supply ports 8 is described below.

Silicon substrates with surfaces having a corresponding one of a {100} orientation, a {110} orientation, and a {111} orientation are often selected. If a silicon substrate having a surface with an orientation other than the {100} orientation is used and MOS transistors are formed on the silicon substrate, the field-effect mobility of electrons and holes in the silicon substrate is nonuniform in the in-plane direction. This causes in-plane dependence and differences in properties. Since interfacial properties thereof are unsatisfactory, good gate insulating layers are unlikely to be formed and therefore failures such as leakage currents are likely to be caused. In the field of microelectromechanical systems (MEMS) in which driving circuits are configured on surfaces, substrates with surfaces having a {100} orientation are suitable. The thickness of the substrates is selected in consideration of the strength required for substrates for ink jet heads.

Examples of a process of forming the ink supply ports 8 include, but are not limited to, anisotropic etching, laser processing, and dry etching.

Figure 2:
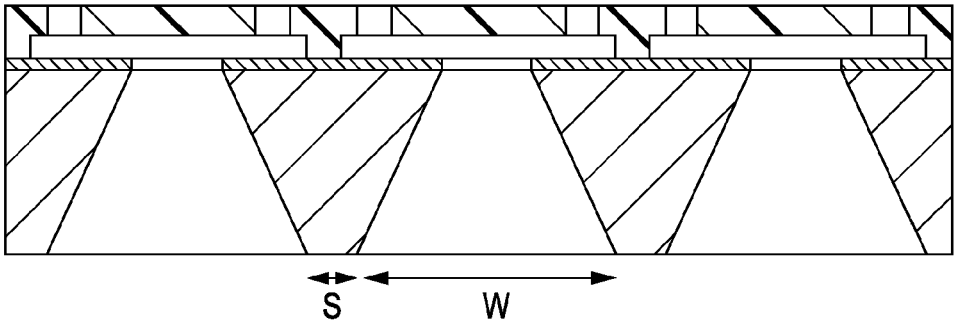
FIG. 2 is a schematic sectional view of an ink jet head manufactured by a conventional method.

The following procedure is usually used to form the ink supply ports 8 in consideration of tact efficiency because portions with a large volume are removed from the substrate 1: an etching mask is formed on the substrate 1 and the substrate 1 is then anisotropically etched. In the procedure, the ink supply ports 8 formed in the substrate 1 have a quadrangular pyramid shape. In order to form the ink supply ports 8 such that the ink supply ports 8 have a target aperture area at an etching end surface, the aperture area (W) of each ink supply port 8 at an etching start surface needs to be set to be large as shown in FIG. 2. If large openings are provided in the etching start surface, a bonding area (S) sufficient to bonding the etching start surface to a support substrate cannot be secured. Ink jet heads with small bonding areas have low reliability because ink leaks from bonded portions and other failures are likely to occur. Therefore, the density and size of the ink supply ports 8 are limited to secure a necessary bonding area.

The ink supply ports 8 can be densely provided in such a manner that the ink supply ports 8 are formed by dry etching so as to have a vertically rectangular shape, because the aperture area of the back surface need not be large. In the case of using a substrate with a surface having in a {100} orientation, walls of the ink supply ports 8 are perpendicular to the {100} plane and are parallel to the {110} plane and therefore such a substrate has low reliability against ink. In order to form the ink supply ports 8 such that walls of the ink supply ports 8 are perpendicular to the {111} plane, the substrate 1 needs to have a surface with a {110} orientation. This can cause in-plane dependence and differences in properties as described above because the field-effect mobility of electrons and holes in a silicon substrate is nonuniform in the in-plane direction thereof in the case of forming MOS transistors or the like on the silicon substrate. Since interfacial properties thereof are unsatisfactory, good gate insulating layers are unlikely to be formed and therefore failures such as leakage currents are likely to be caused.

Figure 3:
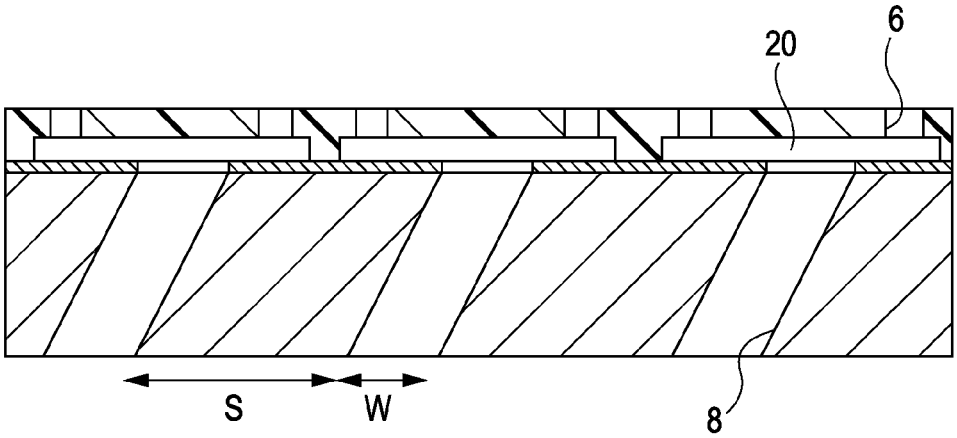
FIG. 3 is a schematic sectional view of an exemplary ink jet head including ink supply ports formed by a method according to the present invention.

The inventors have made intensive investigations and have found that openings having a desired aperture area can be formed in the front surface and openings having a small aperture area can be formed in the back surface in such a manner that the ink supply ports 8 are formed so as to have a rectangular or slit shape in a direction parallel to the {111} plane. Four walls of each ink supply port 8 are all {111} planes and the ink supply port 8 has one or more pairs of parallel surfaces; hence, the back openings can be more greatly reduced in aperture area than conventional ones having a quadrangular pyramid shape as shown in FIG. 3.

Therefore, the ink jet head can be manufactured so as to include the ink supply ports 8 each surrounded by {111} planes resistant to ink. The ink jet head has high reliability because the bonding area (S) between the substrate 1 and the support substrate is large and therefore failures such as the leakage of ink are prevented. Since each ink supply port 8 has a reduced aperture area (W) at the back surface, the ink jet head can be manufactured such that the density of nozzle passages is larger than that of conventional nozzle passages. The ink jet head can be designed to be shrunk. The ink supply ports 8 can be readily arranged to be independent of each other; hence, the ink passages 20 can be formed such that ink is circulated through the ink passages 20.

An exemplary procedure for forming the ink supply ports 8 having a rectangular or slit shape in parallel to the {111} plane is described below.

Figure 1E:
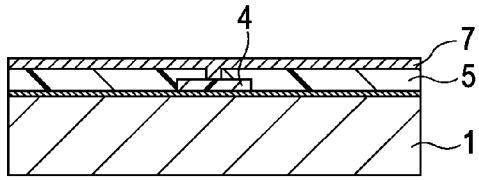

The negative resist layer 5 having surface discharge ports is protected with a protective layer 7 with etching resistance as shown in FIG. 1E. The protective layer 7 needs to be selected such that the ink passage patterns formed on the negative resist layer 5 are not damaged in a step of forming the ink supply ports 8 in the back surface and the removal of the protective layer 7 does not affect water-repellent properties. The protective layer 7 is made of, for example, OBC™ available from Tokyo Ohka Kogyo Co., Ltd.

Figure 1F:
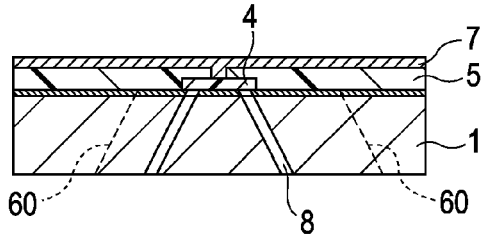

The substrate 1 is drilled from the back surface toward front surface thereof in directions substantially parallel to {111} planes 60 by a dry process such that the aperture area at the front surface is traced, whereby the ink supply ports 8 can be formed as shown in FIG. 1F. The ink supply ports 8 have {111} planes 70 which face each other and which are substantially parallel to each other. The {111} planes 70*a* and 70*b*, which are walls of the ink supply ports 8 and face each other, extend from the back surface to front surface of the substrate 1 substantially in parallel to each other. Examples of a technique for drilling the substrate 1 include, but are not limited to, laser drilling and dry etching.

A Si substrate with a front surface that is a {100} plane has four {111} planes which are not parallel to each other. Therefore, rectangular or slit-shaped ink supply ports can be formed so as to have pairs of walls composed of two {111} planes substantially parallel to each other in such a manner that the Si substrate is drilled in the direction parallel to one of the four {111} planes. Alternatively, ink supply ports can be formed so as to have slits arranged in descending order of length in such a manner that openings in the front surface are fixed and the drilling direction of the Si substrate is shifted with respect to one {111} plane other than a pair of {111} planes substantially parallel to each other.

Rectangular or slit-shaped ink supply ports can be formed so as to each have two pairs of {111} planes substantially parallel to each other in such a manner that the Si substrate is drilled in the direction parallel to the boundary between adjacent two of the four {111} planes. The ink supply ports each have two pairs of {111} planes substantially parallel to each other and all the four walls of each ink supply port are surrounded by {111} planes; hence, the dissolution of Si in ink is reduced. This is preferable.

A laser used to form the ink supply ports in the Si substrate needs to emit light which has a wavelength absorbed by Si and which has intensity sufficient to process Si. Examples of the laser include, but are not limited to, commercially available laser beam machines such as $CO_2$ ultraviolet lasers and solid YAG lasers, which have sufficient absorption intensity with respect to Si and therefore can be used to process Si, including fundamental lasers, second-harmonic lasers, third-harmonic lasers, and similar lasers. Gas and/or plasma may be used to increase the processing accuracy and processing efficiency of the laser. Furthermore, an assist technique, such as aqueous treatment, for removing heat and/or debris (dust) generated during processing may be used.

Figure 4:
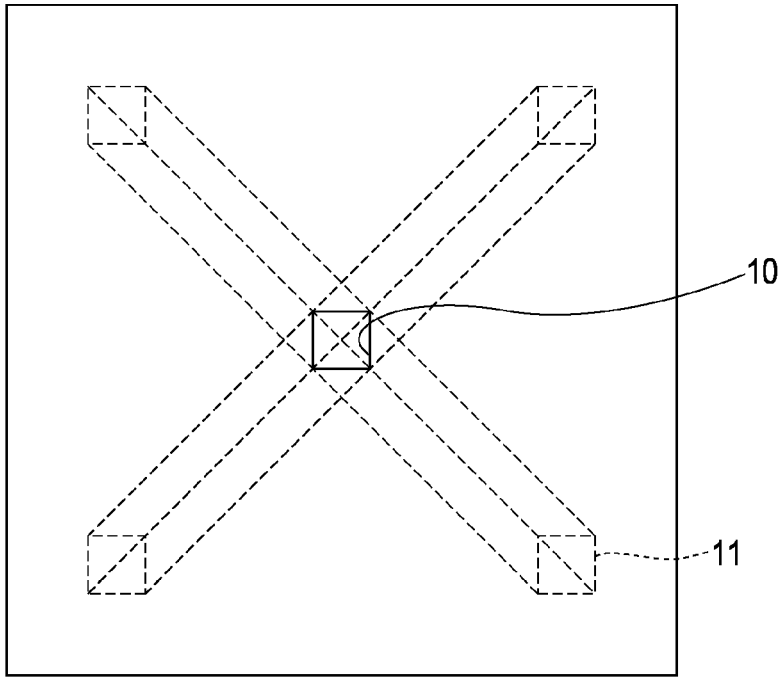
FIG. 4 is a schematic front view of a substrate including an ink supply port which extends from the back surface of the substrate, which has {111} planes parallel to each other, and which has been formed in four directions, a {100} plane of the substrate being viewed from above.

Examples of dry etching, used to form the ink supply ports in the Si substrate, for removing Si include, but are not limited to, dry etching processes, such as Bosch processes and DRIE, capable of performing directional deep drilling. In a substrate with a surface having a {100} orientation, there are four directions having two pairs of {111} planes as shown in FIG. 4. In the case of forming ink supply ports in this substrate by dry etching, for example, a mask is formed on this substrate, this substrate is etched in such a state that this substrate is inclined in a dry etching direction, another mask is formed on this substrate, this substrate is then etched in such a state that this substrate is inclined in another direction. These ink supply ports can be formed so as to extend in two or more directions by repeating this procedure.

Another embodiment of the present invention is described below with reference to FIG. 8. FIG. 8 is a sectional view similar to FIG. 1.

Figure 8A:
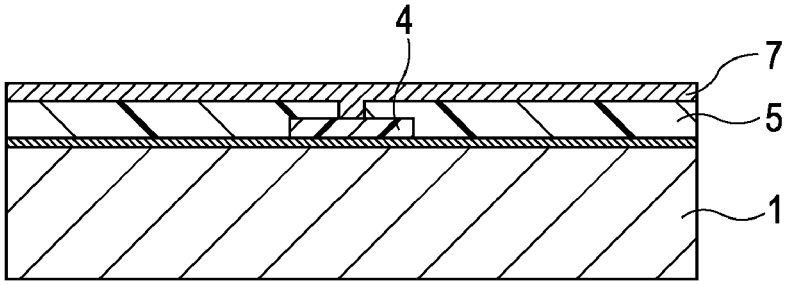
FIGS. 8A to 8C are schematic sectional views each illustrating a state in which a plurality of ink supply ports formed by a method according to the present invention are arranged.
Figure 8B:
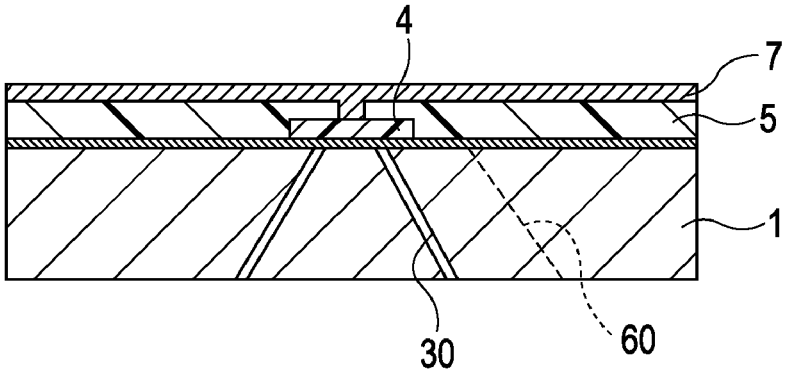
Figure 8C:
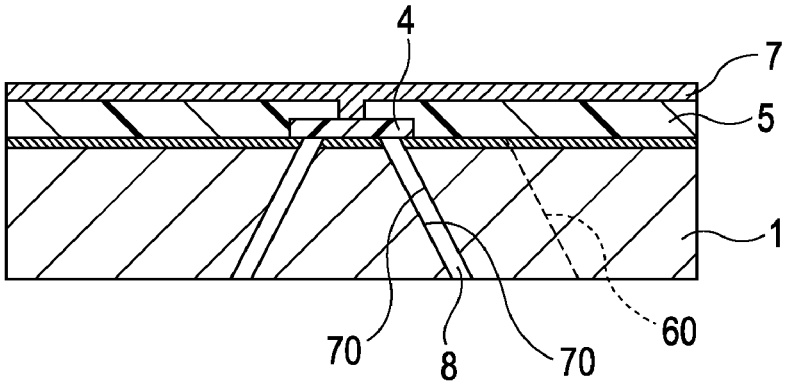

FIG. 8A shows the same state as that shown in FIG. 1E. As shown in FIG. 8B, holes 30 are formed in a substrate by the dry process (laser drilling, dry etching, or the like). The holes 30 extend substantially in parallel to a {111} plane. Unnecessary portions such as burrs and fusion can be removed from walls of the holes 30 by additionally performing anisotropic etching. The holes 30 can be shaped into ink supply ports 8 having clean {111} planes.

Figure 11:
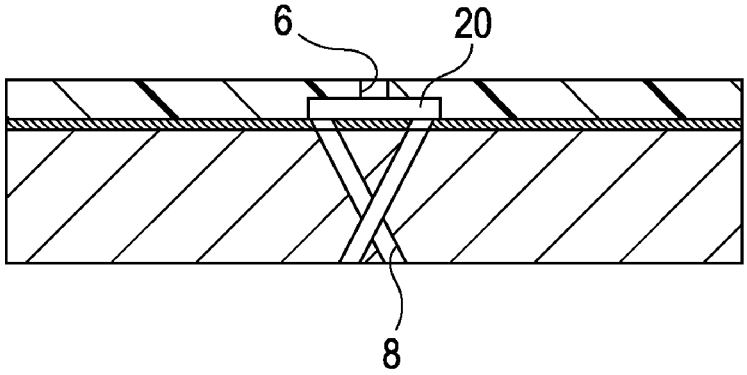
FIG. 11 is a schematic sectional view of an exemplary ink jet head including ink supply ports formed by a method according to the present invention.

Rectangular ink supply ports each having four {111} planes can be formed in a substrate with a surface having a {100} orientation in four directions. This allows these ink supply ports to intersect with each other in this substrate as shown in FIG. 11. The number of intersections of these ink supply ports may be up to four. Debris and the like generated during processing enter these ink supply ports and therefore are preferably removed by an assist technique such as dissolution using anisotropic etching.

Step 3: Communicative Connection of Ink Passages

Figure 1G:
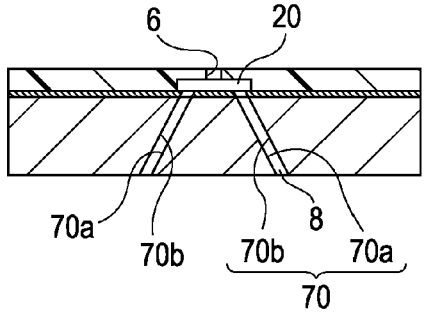

The protective layer 7 is removed from the negative resist layer 5 and the negative resist for forming the ink passage patterns 4 are removed, whereby the ink passages 20 are formed so as to be connected to the ink discharge ports 6 as shown in FIG. 1G.

In this step, the negative resist forming the ink passage patterns 4 is irradiated with an ionizing radiation so as to be degraded, whereby the solubility of the negative resist in a remover is increased. The ionizing radiation may the same as that used to pattern the photodegradable positive resist layer 3. Since an object of this step is to form the ink passages 20 by removing the ink passage patterns 4, the ionizing radiation can be applied to the whole of the negative resist without using a mask. The negative resist forming the ink passage patterns 4 can be completely removed with substantially the same developing liquid as that used to pattern the photodegradable positive resist layer 3. In this step, the following solvent can be used without consideration of patternability: a solvent which is capable of dissolving the negative resist and which has no influence on the negative resist layer 5 or the ink-repellent layer. The ink jet head can be manufactured through the above steps.

After Step 2 is performed to form the ink supply ports 8, Step 1 may be performed to form the ink passages 20 and the ink discharge ports 6. In this case, the substrate 1 has the ink supply ports 8; hence, Step 1 can be performed in such a manner that the ink supply ports 8 are filled with resin or another substrate having ink passages is bonded to the substrate 1.

In the case of bonding the substrate having the ink passages is bonded to the substrate 1 having the ink supply ports 8, there is an advantage in that the ink supply ports 8 can be formed by the dry process so as to extend through the substrate 1 without consideration of influence on walls of the ink passages and therefore conditions of the dry process need not be precisely controlled. However, the following steps are additionally required: a step of correcting the misalignment of the ink passages and a step of removing a treating agent remaining in the ink supply ports 8. Therefore, the bonding of these substrates can be selected depending on the processing load and accuracy of the ink passages and the ink supply ports 8.

EXAMPLES

Examples of the present invention will now be described. The present invention is not limited to the examples.

Example 1

In this example, an ink jet head was manufactured by the method according to the above embodiment.

A substrate 1 made of silicon was prepared as shown in FIG. 1A. The substrate 1 included electrothermal transducers (heaters) serving as energy-generating elements, drivers for driving the electrothermal transducers, and a logic circuit.

The following solution was applied to the substrate 1 by a spin coating process: a solution containing 20% by weight of poly(methyl isopropenyl ketone), ODUR-1010™, available from Tokyo Ohka Kogyo Co., Ltd. The substrate 1 was pre-baked at 120° C. for three minutes on a hot plate and then 150° C. for 30 minutes in an oven filled with nitrogen, whereby a photodegradable positive resist layer 3 with a thickness of 15 μm was formed as shown in FIG. 1A. The photodegradable positive resist layer 3 was irradiated with deep UV light at a dose of 18,000 mJ/cm$^2$ through a mask 2 having a passage pattern using a deep UV exposure system, UX-3000™, available from Ushio Inc. The resulting photodegradable positive resist layer 3 was developed with a solvent mixture of methyl isobutyl ketone (MIBK), which is a nonpolar solvent, and xylene, the ratio of MIBK to xylene in the solvent mixture being 2:3. The resulting photodegradable positive resist layer 3 was rinsed with xylene, whereby ink passage patterns (structures) 4 were formed above the substrate 1 as shown in FIG. 1B.

A negative resist was applied over the structures 4, whereby a negative resist layer 5 was formed as shown in FIG. 1C. The negative resist was used in the form of a resist solution containing 100 mass parts of EHPE-3150™ available from Daicel Chemical Industries Ltd., 20 mass parts of HFAB™ available from Central Glass Co., Ltd., five mass parts of A-187™ available from Nihon Unicar Co., Ltd., two mass parts of SP170™ available from Adeka Corporation, and 80 mass parts of xylene.

In particular, the resist solution applied over the structures 4 by a spin coating process and the substrate 1 was pre-baked at 90° C. for three minutes on a hot plate, whereby the negative resist layer 5. The negative resist layer 5 had a thickness of 20 μm and was flat. An ink-repellent layer (not shown) was formed on the negative resist layer 5 by a laminating process. The ink-repellent layer was made from a resin composition containing 35 mass parts of EHPE-3150™ available from Daicel Chemical Industries Ltd., 25 mass parts of 2,2-bis(4-glycidyloxyphenyl)hexafluoropropane, 25 mass parts of 1,4-bis(2-hydroxyhexafluoroisopropyl)benzene, 16 mass parts of 3-(2-perfluorohexyl)ethoxy-1,2-epoxypropane, four mass parts of A-187™ available from Nihon Unicar Co., Ltd., 1.5 mass parts of SP170™ available from Adeka Corporation, and 200 mass parts of diethylene glycol monoethyl ether.

The ink-repellent layer was exposed to light at a dose of 3,000 mJ/cm$^2$ through a mask having a pattern of ink discharge ports 6 shown in FIG. 1D using Mask Aligner MPA600FA™ available from CANON KABUSHIKI KAISHA.

The ink-repellent layer and the negative resist layer 5 were subjected to post-exposure baking (PEB) at 90° C. for 180 seconds, developed with a solvent mixture of methyl isobutyl ketone and xylene, the ratio of methyl isobutyl ketone to xylene in the solvent mixture being 2:3, and then rinsed with xylene, whereby the ink discharge ports 6 were formed as shown in FIG. 1D.

OBC™ available from Tokyo Ohka Kogyo Co., Ltd. was applied over the ink-repellent layer, whereby a protective layer 7 was formed as shown in FIG. 1E.

Figure 5:
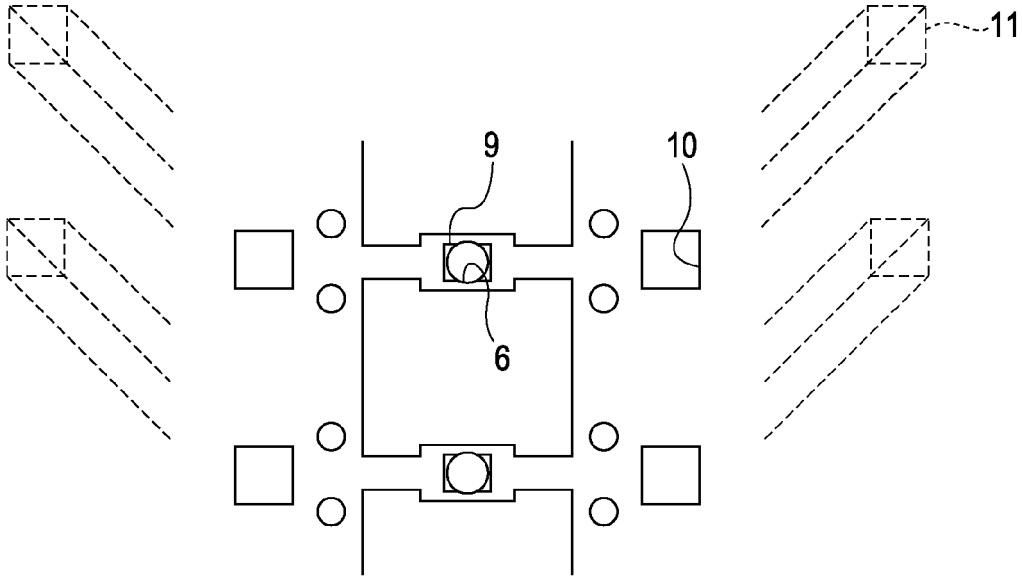
FIG. 5 is a schematic sectional view of an ink jet head manufactured by a method according to the present invention, the ink jet head being viewed in a diagonal direction.

Holes for forming ink supply ports 8 were formed in the back surface of the substrate 1 with a laser. In particular, a laser beam was applied to the substrate 1 in parallel to a {111} plane using a pico-second laser, Hyper Rapid™, available from Lumera in such a manner that the laser beam was inclined at an angle of 54.7 degrees to a {100} plane and a {110} plane. The laser beam was scanned in the X-Y direction and depth direction of the substrate 1 while being inclined to the substrate 1, whereby rectangular ink supply port forms were formed in the substrate 1 in parallel to the {111} plane. The ink supply port forms were processed toward arbitrary portions of the ink passage patterns (structures 4) and then communicatively connected to each other. In this operation, as shown in FIG. 5, laser processing was performed from right and left back-surface laser processing start surfaces 11 (dotted line portions) toward ink supply port openings 10 located at the front surface. Reference numeral 9 represents energy-generating elements for generating energy used to eject ink. The energy-generating elements 9 were arranged opposite the ink discharge ports 6. The rectangular ink supply port forms were anisotropically etched in such a manner that the substrate 1 was immersed in an 80° C. aqueous solution of tetramethylammonium hydroxide, whereby the ink supply ports 8 were formed as shown in FIG. 1F. The ink supply ports 8 each had two {111} planes 70. The number of the ink supply ports 8 was two.

After the protective layer 7 was removed with xylene, the structures 4 forming the ink passage patterns were exposed to light at a dose of 7,000 mJ/cm$^2$ through the ink-repellent layer using a deep UV exposure system, UX-3000™, available from Ushio Inc., whereby the structures 4 were solubilized. The structures 4 were immersed in methyl lactate and ultrasonic waves were applied to the structures 4, whereby the structures 4 were removed as shown in FIG. 1G.

Example 2

An ink jet head was manufactured through substantially the same steps as those described in Example 1 except that a step of forming ink supply ports 8 in the back surface of a substrate 1 was as described below.

Figure 6:
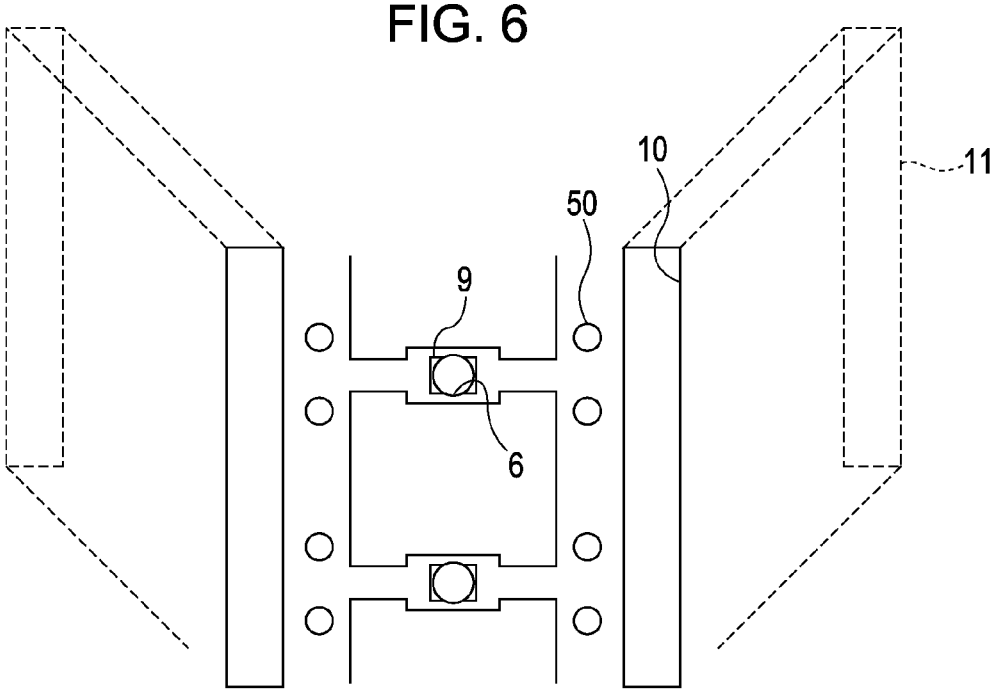
FIG. 6 is a schematic sectional view of an ink jet head manufactured by a method according to the present invention, the ink jet head being viewed in a diagonal direction.
Figure 7:
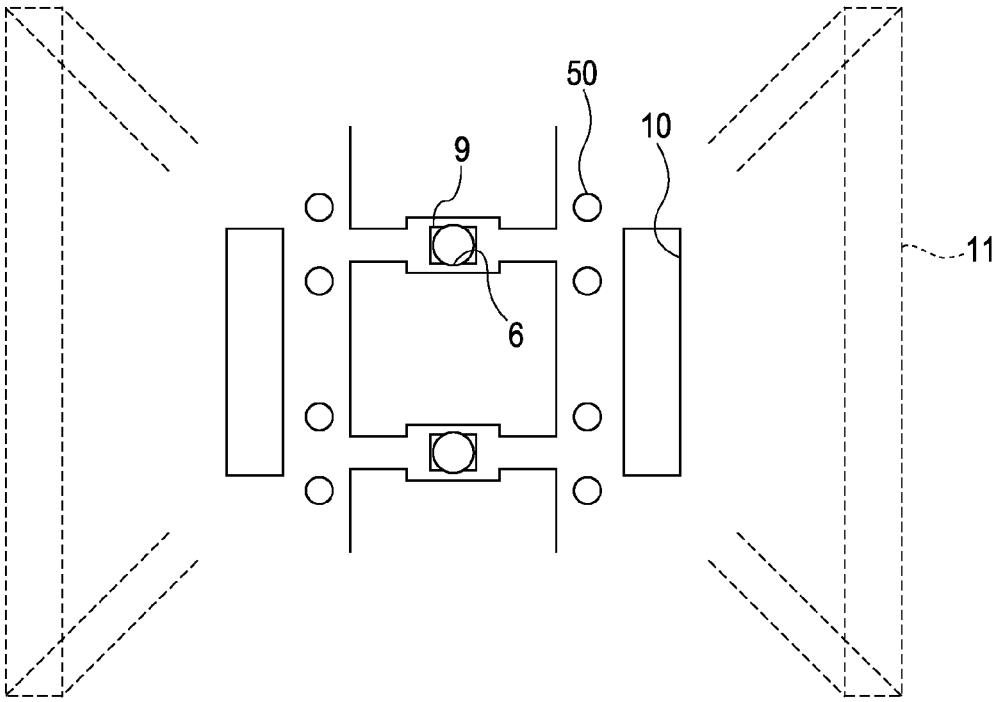
FIG. 7 is a schematic sectional view of an ink jet head manufactured by a method according to the present invention, the ink jet head being viewed in a diagonal direction.

A laser beam was applied to the substrate 1 in parallel to a {111} plane using a pico-second laser, Hyper Rapid™, available from Lumera in such a manner that the laser beam was inclined at an angle of 54.7 degrees to a {100} plane and a {110} plane. The laser beam was scanned in the X-Y direction and depth direction of the substrate 1 while being inclined to the substrate 1, whereby tabular supply port forms were formed in the substrate 1 in parallel to the {111} plane. In this operation, as shown in FIG. 6, laser processing was performed toward ink supply port opening-planned portions 10 located at the front surface such that right and left back-surface laser processing start surfaces 11 (dotted line portions) were rectangular. Reference numeral 50 represents columnar members, disposed in routes from supply ports to energy-generating elements 6, for trapping dust. The slit-shaped supply port forms were anisotropically etched in such a manner that the substrate 1 was immersed in an 80° C. aqueous solution of tetramethylammonium hydroxide, whereby the ink supply ports 8 were formed so as to each have four {111} planes.

Example 3

An ink jet head was manufactured through substantially the same steps as those described in Example 1 except that a step of forming ink supply ports 8 in the back surface of a substrate 1 was as described below.

Figure 9:
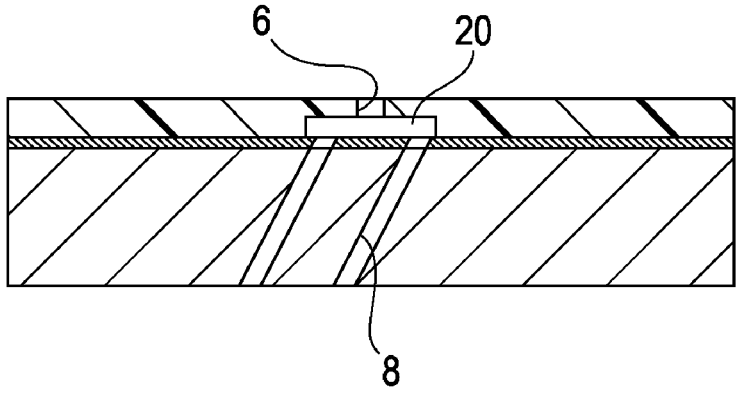
FIG. 9 is a schematic sectional view of an exemplary ink jet head including ink supply ports formed by a method according to the present invention.
Figure 10:
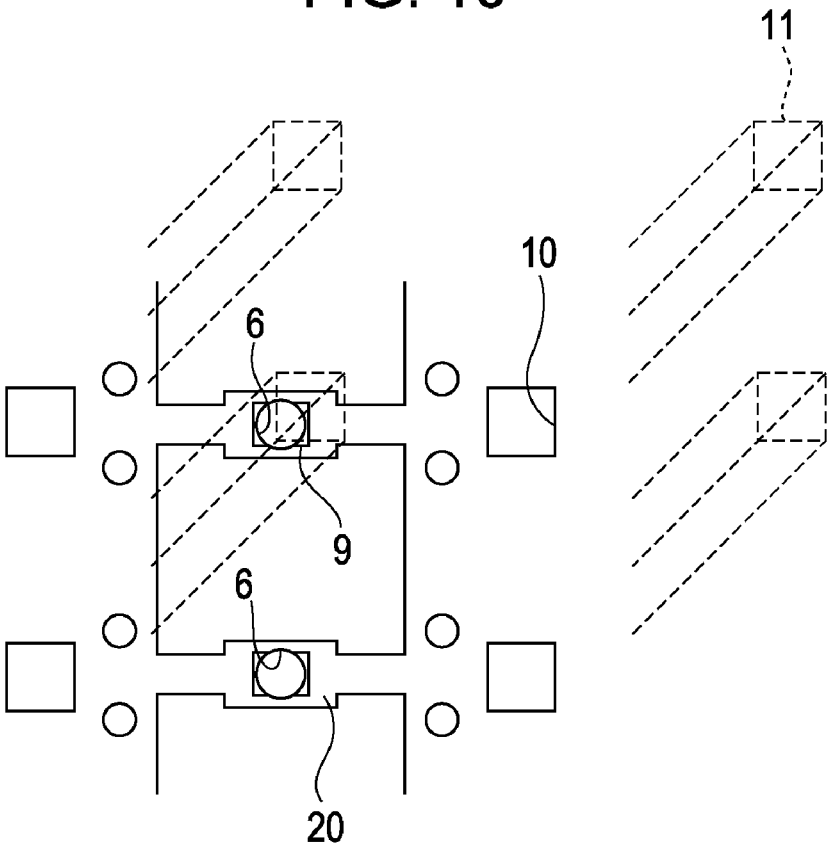
FIG. 10 is a schematic sectional view of an ink jet head manufactured by a method according to the present invention, the ink jet head being viewed in a diagonal direction.

A laser beam was applied to the substrate 1 in parallel to a {111} plane using a pico-second laser, Hyper Rapid™, available from Lumera in such a manner that the laser beam was inclined at an angle of 54.7 degrees to a {100} plane and a {110} plane. The laser beam was scanned in the X-Y direction and depth direction of the substrate 1 while being inclined to the substrate 1, whereby rectangular supply port forms were formed in the substrate 1 in parallel to the {111} plane. In this operation, as shown in FIG. 10, laser processing was performed toward ink supply port openings 10 located at the front surface such that the rectangular supply port forms were parallel to each other. The rectangular supply port forms were anisotropically etched in such a manner that the substrate 1 was immersed in an 80° C. aqueous solution of tetramethylammonium hydroxide, whereby the ink supply ports 8 were formed so as to each have four {111} planes as shown in FIG. 9.

Example 4

An ink jet head was manufactured through substantially the same steps as those described in Example 1 except that a step of forming ink supply ports 8 in the back surface of a substrate 1 was as described below.

Figure 12:
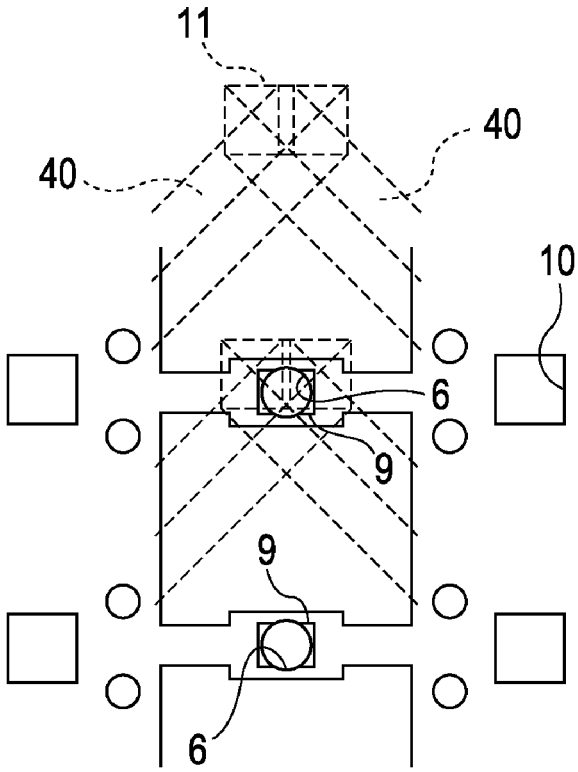
FIG. 12 is a schematic sectional view of an ink jet head manufactured by a method according to the present invention, the ink jet head being viewed in a diagonal direction.

A laser beam was applied to the substrate 1 in parallel to a {111} plane using a pico-second laser, Hyper Rapid™, available from Lumera in such a manner that the laser beam was inclined at an angle of 54.7 degrees to a {100} plane and a {110} plane. The laser beam was scanned in the X-Y direction and depth direction of the substrate 1 while being inclined to the substrate 1, whereby rectangular supply port forms were formed in the substrate 1 in parallel to the {111} plane. In this operation, as shown in FIG. 12, laser processing was performed toward ink supply port openings 10 located at the front surface such that rectangular supply port-planned forms 40 intersected with each other. The rectangular supply port forms were anisotropically etched in such a manner that the substrate 1 was immersed in an 80° C. aqueous solution of tetramethylammonium hydroxide, whereby the ink supply ports 8 were formed so as to each have four {111} planes as shown in FIG. 11.

Example 5

An ink jet head was manufactured through substantially the same steps as those described in Example 1 except that a step of forming ink supply ports 8 in the back surface of a substrate 1 was as described below.

The substrate 1 was dry-etched in parallel to a {111} plane using a dry etching system, Pegasus™, available from Sumitomo Precision Products Co., Ltd. in such a manner that the substrate 1 was inclined at an angle of 54.7 degrees to a {100} plane and a {110} plane. Rectangular supply port forms were anisotropically etched in such a manner that the substrate 1 was immersed in an 80° C. aqueous solution of tetramethylammonium hydroxide, whereby the ink supply ports 8 were formed so as to each have four {111} planes as shown in FIG. 10.

The ink jet heads manufactured in Examples 1 to 5, ink tanks, and other components were assembled into ink jet units. Each ink jet unit was mounted on a printer and then evaluated for ejection and recording. This showed that printing was performed stably and obtained prints had high quality.

Comparative Example 1

In order to confirm advantages of the present invention, an ink jet head for comparison was manufactured as described below. In this comparative example, the ink jet head included a substrate 1 identical to that described in Example 1 and a common supply port disposed in the back surface of the substrate 1. In a step of forming the common supply port in the back surface of the substrate 1, OBC™ available from Tokyo Ohka Kogyo Co., Ltd. was applied over an ink-repellent layer, whereby a protective layer 7 was formed. An etching mask with a slit was formed on the back surface of the substrate 1 using a polyether amide resin, HIMAL™, available from Hitachi Chemical Co., Ltd. The substrate 1 was immersed in an 80° C. aqueous solution of tetramethylammonium hydroxide, whereby the substrate 1 was anisotropically etched, resulting in the formation of the common supply port. The shape of the etching mask was adjusted at an etching start surface such that a form including openings formed at an etching end surface in Example 1 was obtained.

After OBC™, that is, the protective layer 7 was removed with xylene, an ink-repellent layer was entirely exposed to light at a dose of 7,000 mJ/cm$^2$ through using a deep UV exposure system, UX-3000™, available from Ushio Inc. This allowed a negative resist for forming ink passage patterns to be solubilized. The ink passage patterns were removed in such a manner that the ink passage patterns were immersed in methyl lactate and ultrasonic waves were applied to the ink passage patterns, whereby the ink jet head was obtained.

In the ink jet head manufactured as described above, ink leakage was observed when the substrate 1 was bonded to a support substrate. This is probably because an etching start surface has an opening with a large area and therefore the adhesion between the substrate 1 and the support substrate is insufficient.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-318510 filed Dec. 15, 2008, which is hereby incorporated by reference herein in its entirety.

What is claimed is:

1. An ink jet head comprising:

a Si substrate with a surface having a {100} orientation;

a member on the Si substrate, the member forming an ink passage and an ink discharge port communicatively connected to the passage; and a supply port which extends through the Si substrate, which is communicatively connected to the ink passage, and which supplies ink to the ink passage, wherein the supply port has walls having two {111} planes facing each other, the two {111} planes being substantially parallel with each other.

2. The ink jet head according to claim 1, wherein the supply port has walls having two pairs of {111} planes facing each other, two {111} planes of each pair being substantially parallel with each other.

3. The ink jet head according to claim 1, wherein the Si substrate includes a plurality of supply ports identical to the supply port and the supply ports have openings which are located at the front surface of the Si substrate and which are independently communicatively connected to the passage.

4. The ink jet head according to claim 3, wherein the supply ports are communicatively connected to the single passage.

5. The ink jet head according to claim 3, wherein the supply ports intersect with each other in the Si substrate.

* * * * *